United States Patent [19]

Lofberg

[11] 4,069,852

[45] Jan. 24, 1978

[54] CONTAINERS

[75] Inventor: Gustaf Gerhard Lofberg, Landskrona, Sweden

[73] Assignee: Supra Aktiebolag, Landskrona, Sweden

[21] Appl. No.: 750,551

[22] Filed: Dec. 14, 1976

[30] Foreign Application Priority Data

Jan. 13, 1976 Sweden ..... 7600295

[51] Int. Cl.[2] ..... B65D 33/14

[52] U.S. Cl. ..... 150/1; 150/8

[58] Field of Search ..... 150/.5, 1, 3, 8, 12

[56] References Cited

U.S. PATENT DOCUMENTS

| | | | |
|---|---|---|---|
| 2,795,257 | 6/1957 | Cunningham | 150/1 |
| 3,028,897 | 4/1962 | Gooding | 150/1 |
| 3,199,726 | 8/1965 | Pierson | 150/1 X |
| 3,973,609 | 8/1976 | Lofberg | 150/1 |

*Primary Examiner*—Donald F. Norton

*Attorney, Agent, or Firm*—Fleit & Jacobson

[57] ABSTRACT

There is provided a container comprising a casing having an upper portion and a bottom, and a rope the ends of which are respectively anchored to the upper portion and the bottom of the container. The rope extends through the container space and part of the rope is routed at the top of the container in a manner to form a loop by which the container may be lifted. To protect goods stored within the container from being impaired as a result of moisture or water migrating along that portion of the rope extending through the container, said rope portion is enclosed in a liquid-tight fashion in a protective device.

6 Claims, 2 Drawing Figures

CONTAINERS

The present invention relates to improvements in a container of the type comprising a casing with an upper portion and a bottom, and an elongate member, one end of which member is attached to the upper portion of the casing and part of which member passes through an opening in said upper portion and through the container space, and the other end of which member is attached or anchored to the bottom of the casing, said elongate member extending from its point of attachment to the upper portion of the casing and upwardly beyond said opening to form a loop by which the container may be lifted.

In such a container, moisture and water tend to move along the elongate member, through the opening in the upper portion of the casing and into the container space, thereby moistening any goods contained therein. This is particularly the case when, in order to distribute the load, the elongate member is slideably arranged in said opening. This migration of moisture and/or water along the elongate member causes particular problems when the goods in the container are sensitive to moisture.

For the purpose of at least substantially eliminating the aforementioned problems, it is proposed in accordance with the invention to provide a container of the aforedescribed type which further comprises a protective device extending through said container space such as to shield in a liquid-tight fashion the container space from that part of the elongate member extending through said container space between said opening and its anchorage point at the bottom of the casing.

The protective device may have the form of a pipe, made for example of a soft, pliant material, surrounding that part of the elongate member which extends through the container space from said opening to said bottom anchorage.

Suitably, the container comprises a sack having an upper edge portion which is gathered around the elongate member between its ends, wherein said upper edge portion of the sack is held gathered around the elongate member via the pipe, and wherein an end portion of the pipe at the upper portion of the casing is folded back over said edge portion.

Part of said upper edge portion is preferably gathered around the elongate member and the pipe by means of a separate securing means, whilst the remaining portion of the upper edge portion forms an opening through which the sack may be filled, said remaining portion being arranged to be gathered around the elongate member and the pipe subsequent to filling the sack.

When one or both ends of the elongate member is or are anchored to the casing via respective intermediate members, the pipe preferably also surrounds said intermediate member or members.

The invention will now be described in more detail with reference to an exemplary embodiment thereof shown in the accompanying schematic drawings, further features of the invention and advantages afforded thereby being made apparent in conjunction therewith.

Figure 1:
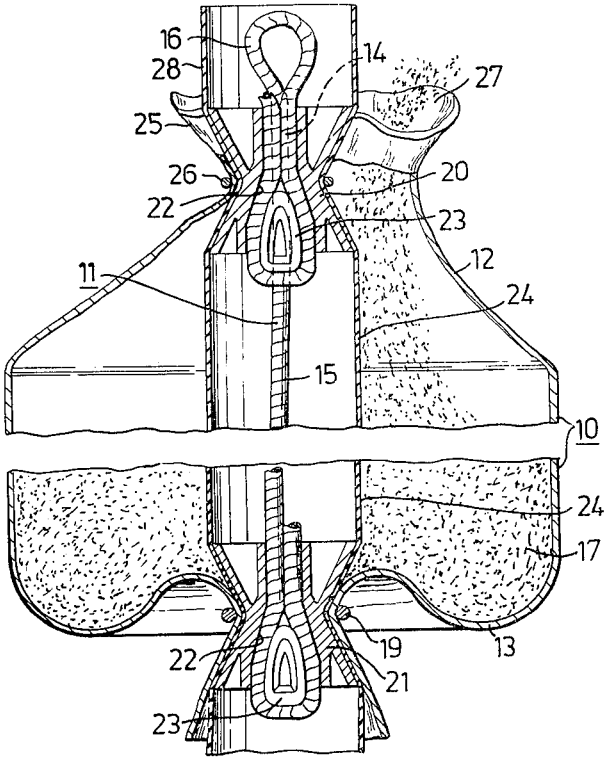
FIG. 1 is an axial sectional view of the upper and lower portion of a container constructed in accordance with the invention, and shows the container in the process of being filled.
Figure 2:
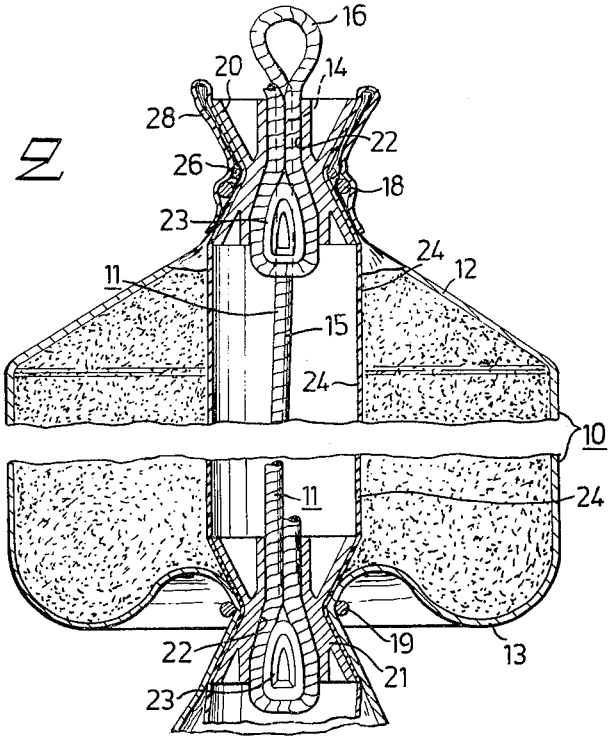
FIG. 2 is a view similar to the view of the container shown in FIG. 1, althoughin FIG. 2 the container is shown to be filled and sealed.

The container shown in FIGS. 1 and 2 comprises a casing 10 and a flexible elongate member shown generally at 11. The upper and lower portions of the casing 10 are identified by the references 12 and 13 respectively. One end of the member 11, which may have the form of a rope (as shown), a chain or like member, is attached to the upper portion 12 of the casing 10 whilst its other end is attached to the bottom portion 13, the rope passing slideably through an opening 14 arranged in an insert member as described hereinafter, and a part 15 of said rope extending freely downwardly through the container space. As shown in the drawing, the rope is so laid as to form an external loop 16.

When lifting the container by means of a lifting-hook or some other lifting device passed through the external rope-loop 16, which hook shall permit the rope to slide such that stresses occurring in the rope when a loaded container is lifted are distributed in both portions of the rope loop, these stresses are transferred to and distributed substantially evenly between the upper portion 12 and the bottom 13 of the casing 10. The part 15 of the rope extending through the container space thus forms a load-distributing means which transmits part of the total strain acting in the rope when lifting a loaded container, to the bottom 13 of the container.

The illustrated container casing 10 comprises a sack formed by gathering and securing together the two ends of a flexible hose, which may be stretchable to some extent and which may be made, for example, of thin plastics material, a plastics-coated paper or fabric material, said sack being intended for one-time use only or for multiple use. The contents of the container are indicated by reference 17. The two ends of the hose are gathered together by means of respective ropes 18 and 19 (FIG. 2). The two ends of the rope 11 are anchored to the casing 10 via intermediate members 20, 21, the portion of the rope located between said ends being able to slide freely through the through-passing opening 14, shown in dash lines, in the upper intermediate member 20. The intermediate members 20, 21 are provided with peripheral grooves, and the casing is gathered and held around the intermediate members in said grooves by means of the ropes 18, 19. The rope 19 is suitably tied around the casing 10 and the intermediate member 21 by means of a readily released knot. Thus, the container can readily be emptied, by releasing said knot, thereby preventing damage to the casing 10 when emptying the same.

Each of the intermediate members 20, 21 comprises a rigid body substantially of hour-glass configuration, which body may be provided with cavities for the purpose of saving material, as shown in the Figures. Passing axially through each of said bodies is a hole 22, which together with a wedge-shaped insert 23 forms a wedge-locking device for releasably securing one end portion of the rope 11. In the illustrated embodiment, the hole 22 has an upper portion whose cross-sectional area and shape are such that said upper portion corresponds substantially to the cross-sectional shape of two adjacently located portions of the rope 11, a lower portion whose cross-sectional area and shape are such as to correspond substantially to the largest cross-section of the insert 23 and two adjacently located portions of the rope 11, and an intermediate, upwardly narrowing portion. The end portions of the rope 11 are fixed in the intermediate members 20, 21 by doubling them around the insert 23 and passing them into the hole 22 in the manner illustrated in FIGS. 1 and 2. It will be seen that the wedging action between the narrowing portion of the hole 22 and the insert 23 and the portions of the rope 11 passing around the inserts 23 increases as tension is applied on the loop 16 or on the portion of the rope 11 shown at 15. The members 20 and 21 may be made from a suitable plastics material and for increasing the load carrying capacity of said members each hole 22 may then to advantage be lined with a metallic lining (not shown) at least in said intermediate, upwardly narrowing portion thereof.

In accordance with the invention, the container is also provided with a device 24 which extends through the container space and which will shield the goods 17 in a liquid-tight fashion from the rope-portion 15 extending between the opening 14 and the lower intermediate member 21. In the illustrated embodiment, the device 24 comprises a thin pipe of soft, pliant material, for example a suitable plastics material, surrounding the rope portion 15, which material may be elastically or plastically stretchable. The pipe 24 is pressed against the intermediate members 20, 21 at the upper and lower ends of the container by means of the rope 18, 19 via the casing 10, when the container is sealed. As shown in FIG. 1, the upper edge portion 25 of the sack-shaped container may be gathered around a first part of its circumference, around the upper intermediate member 20 and the pipe 24 by means of a separate securing member 26, whilst the remainder of said upper edge portion forms an opening 27 (FIG. 1) through which the container may be filled. The securing member 26 may comprise a rope which passes through two holes in the casing, or may comprise a spring clamp or the like fixed around the intermediate member 20, the pipe 24 and said part of the edge portion 25. Subsequent to filling the container, the remaining portion of the edge portion 25 is gathered around and against the pipe 24 and the intermediate member 20 by means of the rope 18. The end portion 28 of the pipe 24 at the upper portion of the casing may suitably be folded back over the edge portion 25 gathered around the intermediate member 20, prior to or subsequent to placing the rope 18 in position, so that holes which may have been formed in the casing 10 to accommodate the member 26 are sealed and so that moisture and water are prevented from passing into the container space along the outside of the intermediate member 20 and the inside of the edge portion 25. The lower, intermediate member 21 may be provided with a further through-passing hole, for example a hole similar to the hole 14 in the upper intermediate member 20, to enable water which has entered the pipe 24 to be drained therefrom.

It will be understood that one or both of the intermediate members 20, 21 may be omitted, in which case the pipe 24 and the edge portions of the casing 10 are brought together directly around the rope 11 at the upper and/or lower casing end of the container. Further, when the casing is rigid, the pipe 24 may also be rigid. Thus, the invention is not restricted to the described and illustrated embodiment, but can be modified within the scope of the following claims.

I claim:

1. A container comprising a casing having an upper portion and a bottom, and an elongate member which is attached at one end to said upper portion and part of which extends through an opening in said upper portion and through the container space, with the other end of the elongate member being anchored to the bottom of the casing, the elongate member extending from the area of attachment to the upper portion of the casing and upwardly beyond said opening to form a loop by which the container may be lifted, said container further comprising a protective device extending through said container space such as to shield in a liquid-tight fashion the container space from that part of the elongate member extending through said container space between said opening and its anchorage point at the bottom of the casing.

2. A container according to claim 1, wherein the protective device comprises a pipe surrounding said part of the elongate member extending through said container space.

3. A container according to claim 2, wherein the pipe is made of a soft, pliant material.

4. A container according to claim 3, wherein the casing is comprised of a sack having an upper edge portion which is gathered around the elongate member between it ends, wherein said upper edge portion is held gathered around the elongate member via the pipe, and wherein an end portion of the pipe at the upper portion of the casing is folded back over said upper edge portion of the sack.

5. A container according to claim 4, wherein said upper edge portion of the sack along a portion of the circumference of said upper edge portion is gathered around and secured around the elongate member and the pipe by means of a separate securing means, whilst the remaining portion thereof forms an opening through which the sack may be filled, said remaining portion being arranged to be gathered around the elongate member and the pipe subsequent to filling the sack.

6. A container as claimed in claim 2 in which at least one of the ends of the elongate member is anchored to the casing via an intermediate member which in turn is releasably joined to the casing, wherein the pipe also surrounds said intermediate member.

* * * * *